United States Patent [19]

Gagnet

[11] Patent Number: 5,009,576

[45] Date of Patent: Apr. 23, 1991

[54] COMPRESSOR UNLOADER CONTROLLER

[75] Inventor: Thomas R. Gagnet, Moneta, Va.

[73] Assignee: Ingersoll-Rand Company, Woodcliff Lake, N.J.

[21] Appl. No.: 462,164

[22] Filed: Jan. 8, 1990

[51] Int. Cl.[5] ..... F04B 49/00

[52] U.S. Cl. ..... 417/295

[58] Field of Search ..... 417/295, 297, 279

[56] References Cited

U.S. PATENT DOCUMENTS

| | | | |
|---|---|---|---|
| 2,997,227 | 8/1961 | Ternent | 417/295 |
| 3,582,233 | 6/1971 | Bloom | 417/295 |
| 3,669,579 | 6/1972 | Carter | 417/295 |
| 3,860,363 | 1/1975 | Silvern | 417/295 |
| 4,171,188 | 10/1979 | Anderson et al. | 417/295 |
| 4,470,427 | 9/1984 | Maillochand | 137/112 |

*Primary Examiner*—Leonard E. Smith
*Assistant Examiner*—David W. Scheuermann
*Attorney, Agent, or Firm*—Glenn B. Foster

[57] ABSTRACT

A compressor unloader controller for placing a compressor in an unloaded condition when the compressor is being started. A compressor inlet valve, movable between a normally open and a closed position, admits fluid flow to the compressor when the valve is in the open position. A pressure reservoir contains pressure sufficient to bias the inlet valve into the closed position. A starter valve applies pressure from the pressure reservoir to the inlet valve only when the compressor is in a starting mode. The inlet valve may also be actuated, during normal compressor operation, by a pressure regulating device which is connected to a compressor outlet line.

7 Claims, 1 Drawing Sheet

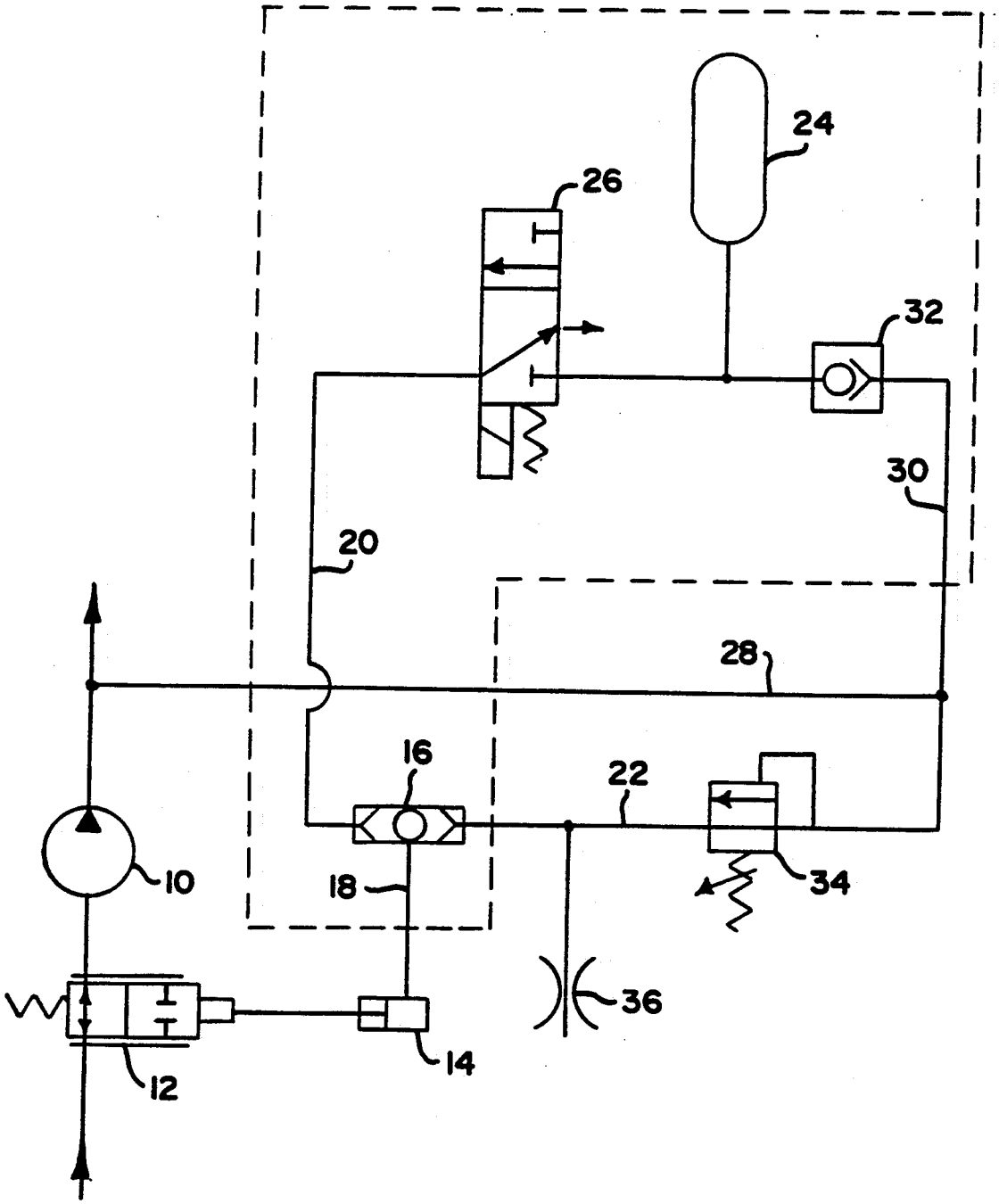
24
26
32
30
20
28
16
22
10
18
34
36
14
12

COMPRESSOR UNLOADER CONTROLLER

BACKGROUND OF THE INVENTION

This invention relates generally to compressors, and more particularly to a controller to place the compressor in an unloaded state when the compressor is being started. A pressure reservoir is used to apply pressure to the compressor inlet valve whenever the compressor is being started.

Previously, timing devices have been used to place compressors in an unloaded state during compressor startup. These devices are relatively complex, and require an additional compressed air source to function.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus comprising a compressor having an inlet and an outlet. A compressor inlet valve means, movable between a normally open and a closed position, regulates fluid flow to the compressor inlet. A pressure reservoir contains pressure sufficient to bias the compressor inlet valve means into the closed position. Means are included for separating the pressure in the reservoir from the pressure in the outlet of the compressor. A starter valve is normally closed when the compressor is not operating and is opened during the starting of the compressor.

BRIEF DESCRIPTION OF THE DRAWING

The drawing is a schematic diagram illustrating an embodiment of the compressor unloader controller of the instant invention.

The elements of the invention which differ from the prior art unloader valves are encircled by the dotted line.

DETAILED DESCRIPTION

The fluid flow to a compressor 10 is controlled by a normally open inlet valve 12. During start up of the compressor, resistance caused by fluid in the compressor must be overcome as the compressor accelerates. This problem is especially pronounced during cold weather starts Therefore, during start up, it is desired to place the inlet valve in a closed position, which is caused by movement of piston 14.

Movement of the piston (which closes the inlet valve 12), is effected by fluid pressure passing through a shuttle valve 16 and shuttle exit line 18. There is a first and a second shuttle inlet line 20 and 22 which are applied to shuttle valve 16. Whichever pressure between the two inlet lines 20, 22 is greatest will be applied to the shuttle exit line 18.

The pressure applied to the first inlet line 20 is supplied by a pressure reservoir 24. A normally closed starter valve 26, which is preferably electrically operated, is actuated only when the compressor is being started. After the compressor is started, the actuator valve 26 is deactuated permitting it to return to it's normally closed position. This actuation may be accomplished manually or by connecting the valve to whatever mechanism acts to start the compressor.

When the valve 26 is in its open position, pressure from the pressure reservoir 24 will be applied to shuttle valve 16. When the valve 26 is in its closed position, all pressure in the first shuttle inlet line 20 will be vented to the atmosphere through valve 26.

Pressure to the pressure reservoir 24 is supplied by the compressor 10 via conduits 28, 30 and a check valve 32. The check valve 32 restricts fluid flow from the pressure reservoir 24 into conduit 30, but permits flow from the conduit 30 to pressure reservoir 24 only when pressure in the conduit 30 exceeds pressure in the pressure reservoir. In this manner, the pressure reservoir will be exposed to the greater pressure of an existing pressure in the pressure reservoir and pressure in the compressor 10.

Pressure in the second shuttle inlet line 22 is also supplied from compressor 10. During the operation of the compressor, it is desired to precisely control the position of compressor inlet valve 12.

To accomplish this, a pressure regulating valve 34 and an orifice 36 (which is vented to the atmosphere) interact to maintain pressure in the second inlet line 22 at a relative amount compared to the pressure in conduit 28. This pressure will bias shuttle valve 16 to expose the pressure in line 22 to the piston 14, since the pressure in line 20 will be vented to the atmosphere through valve 26.

In an alternative embodiment, the combined functions of the pressure regulating valve 34 and the orifice 36 can be accomplished by other pressure regulating devices.

While this invention has been illustrated and described in accordance with a preferred embodiment, it is recognized that variations and changes may be made therein without departing from the invention as set forth in the claims.

What is claimed is:

1. An apparatus comprising:

a compressor having an inlet and an outlet;

compressor inlet valve means, movable between a normally open and a closed position, for regulating fluid flow to the compressor inlet;

a pressure reservoir containing pressure sufficient to bias the compressor inlet valve means into the closed position;

means for separating the pressure in the reservoir from the pressure in the outlet of the compressor; and starter valve means for applying pressure from the pressure reservoir to the inlet valve means, which is normally closed when the compressor is not operating and is opened during the starting of the compressor.

2. The apparatus as described in claim 1, further comprising:

a shuttle valve having first and second inlet lines and one exit line, the first inlet line being connected to the starter valve; and a pressure regulating valve, connected between the compressor and the second inlet line.

3. The apparatus as described in claim 2, further comprising:

an orifice inserted in the second inlet line in communication with the atmosphere, wherein the second inlet line is in communication with the outlet of said pressure regulating valve.

4. The apparatus as described in claim 1, wherein the compressor inlet valve means is pressure controlled, further comprising:

a check valve means for applying the greater pressure of the pressure reservoir and the compressor outlet to the compressor inlet valve means.

5. The apparatus as defined in claim 1, further comprising:

piston means for controlling the position of the inlet valve means.

6. The apparatus as defined in claim 1, further comprising:

a shuttle valve having first and second inlet lines and one exit line, the first inlet line being connected to the starter valve means; and a pressure regulating device, connected between the compressor and the second inlet line.

7. The apparatus as described in claim 1, wherein the inlet valve means is integrally movable to a multitude of positions between the normally open and the closed positions.

* * * * *